US006081956A

United States Patent [19]

Boys

[11] Patent Number: 6,081,956

[45] Date of Patent: Jul. 4, 2000

[54] METHOD AND APPARATUS FOR CLEANSING THE INTERNAL ROLLERS OF A COMPUTER POINTER DEVICE

[76] Inventor: Mark A. Boys, 7121 W. Zayante Rd., Felton, Calif. 95018

[21] Appl. No.: 09/066,725

[22] Filed: Apr. 23, 1998

[51] Int. Cl.[7] ..... B08B 9/00

[52] U.S. Cl. ..... 15/21.2; 15/22.1; 15/256.52

[58] Field of Search ..... 134/6; 15/21.1, 15/21.2, 22.1, 32, 34, 256.52, 304

[56] References Cited

U.S. PATENT DOCUMENTS

| | | | |
|---|---|---|---|
| 2,632,191 | 3/1953 | Grafani . | |
| 3,118,162 | 1/1964 | Karr et al. . | |
| 4,760,618 | 8/1988 | Chapin, Jr. | 15/104.93 |
| 5,235,717 | 8/1993 | Lanzo, Jr. et al. | 15/97.1 |
| 5,237,376 | 8/1993 | Giardina | 355/301 |
| 5,418,999 | 5/1995 | Smith | 15/106 |
| 5,896,124 | 4/1999 | Strandberg . | |
| 5,970,559 | 10/1999 | Christy . | |

*Primary Examiner*—Frankie L. Stinson
*Attorney, Agent, or Firm*—Donald R. Boys; Central Coast Patent Agency

[57] ABSTRACT

A cleaning apparatus for computer pointer devices having a standard ball contacting input rollers has an abradant ball mounted to a rotary shaft in a manner that the abradant ball may be brought into contact with rollers of the pointer device with the standard ball removed, the position of the abradant ball such that rotating the shaft will rotate the abradant ball in a manner that the abradant ball will both abrade and turn the rollers. The cleaning apparatus may be a hand-held device, built into a free-standing housing, or into a housing as a part of another computer housing, such as a computer or display. In some cases there is a variable speed drive with user settable speed, and in some cases there is a vacuuming system for removing abraded matter from a pointer device while cleaning takes place.

4 Claims, 4 Drawing Sheets

METHOD AND APPARATUS FOR CLEANSING THE INTERNAL ROLLERS OF A COMPUTER POINTER DEVICE

FIELD OF THE INVENTION

The present invention is in the field of input devices for personal computers and has particular application to pointer devices such as computer mouse devices and trackballs, and teaches methods and apparatus for cleansing the internal rollers and associated elements of such devices.

BACKGROUND OF THE INVENTION

Input devices used for personal computers such as pointer devices for cursor control, such as mouse and trackball devices, have traditionally been the most commonly used input devices for controlling cursor movement on a computer screen. A computer mouse is a device that a user can move across a pad thereby controlling cursor movement and cursor-related functions on a computer screen via a calibrated ball that rolls across the surface of a pad as the mouse is caused to move. Coded signals sent by a computer mouse are decoded with the aid of software in the computer, and the signals received are often and interfaced with the appropriate features within an application being used.

A computer mouse or trackball is typically physically enabled via a ball and two internal rollers. The rollers are held against the ball by springs or other tension devices. The ball inside a mouse is designed for rolling on a desk or mouse-pad as a user operates the device. As the ball rolls on a surface, calibrated contact-rollers that interface to the ball move in conjunction with the ball thus enabling cursor movement. Typically one roller is set at right angles to another with one providing input for x-direction movement and the other for y-direction movement. A trackball operates much in the same way as a conventional mouse accept that instead of moving the input device across a mouse pad, the device is stationary and a user manipulates the ball directly to provide the same type of input as would be the case with a mouse.

One problem with the ball-roller system of a mouse is that the internal rollers of the mouse or track ball inevitably become contaminated with lint, dirt, grime, hair, and other types of particulate matter present in the environment. When the ball and roller system of a mouse or track ball becomes contaminated, the efficiency of the device related to cursor movement begins to degrade.

Cleaning the internal rollers of a mouse or track ball is often a tedious and monotonous process. This process involves removing the rubber ball from the bottom of the mouse (from the top with a track ball) and manually scraping the rollers with a knife or other device. Often heavy lint must be tweezed out from rollers and tension devices with a pair of tweezers or other such implement. Manual cleaning operations may take considerable time depending on the type of contamination. If one is not careful during the cleaning process, rollers may be damaged by scratching or gouging. In some cases, new device components may be required to replace components such as rollers damaged during scraping. More often it is necessary to purchase and install a new pointer device to achieve expected fuctionality.

What is clearly needed is method and apparatus for cleaning the rollers of a mouse or track ball that eliminates the need for manual operations such as scraping, tweezing, swabbing, and the like.

SUMMARY OF THE INVENTION

In a preferred embodiment of the present invention a hand-held cleaning apparatus for a computer pointing device having a rollable ball of a standard size and internal rollers adapted to provide directional input is provided, comprising a housing adapted to a user's hand; a rotatable shaft connected to a rotary drive within the housing; and a cleaning ball having an abradant surface mounted to the rotatable shaft outside the housing. An on-off switch is typically provided for activation and de-activation. The rotary drive may be a variable speed drive including a user-input for varying the speed. There may be in addition an air pump connected to openings through the surface of the abradant ball, providing ingress of air to sweep matter abraded from the rollers from within the pointer device.

In an aspect of the invention a ball having an abradant surface is provided, the ball adapted for mounting to a rotary shaft of a hand-held rotary tool. The abradant surface can take many forms, such a brush-like bristles on the ball surface.

In another aspect an apparatus adapted for cleaning rollers for a computer pointing device having a rollable ball of a standard size and internal rollers adapted to provide directional input is provided, the apparatus comprising a housing having an upper surface with an upper opening; a rotatable shaft connected to a rotary drive within the housing and directed through the upper opening; a cleaning ball having an abradant surface mounted to the rotatable shaft outside the housing; and a user-operable input adapted for activating the rotary drive. In this aspect the housing may be adapted to stand on a supporting surface, or may be a part of another housing, such as for a computer or video display. Also in this aspect the cleaning ball may be presented at a position such that a pointer device having the rollable ball of standard size removed, presented to the apparatus such that the cleaning ball engages the rollers of the pointer device, has a surface of the pointer device contacting the upper surface of the housing. In this case the user-operable input may be implemented on the upper surface of the housing, such that the contact of the surface of the pointer device with the upper surface of the housing operates the input device and activates the rotary drive. There may also be a variable-speed rotary drive, and there may be an air pump to provide for removal of abraded material.

Methods for practicing the invention are disclosed and claimed below as well. In the various aspects of the invention taught in enabling detail below, apparatus and methods are provided to meet a long-standing need, which is to keep mouse and trackball devices clean and operating properly.

BRIEF DESCRIPTION OF THE DRAWING FIGURES

DESCRIPTION OF THE PREFERRED EMBODIMENTS

Figure 1:
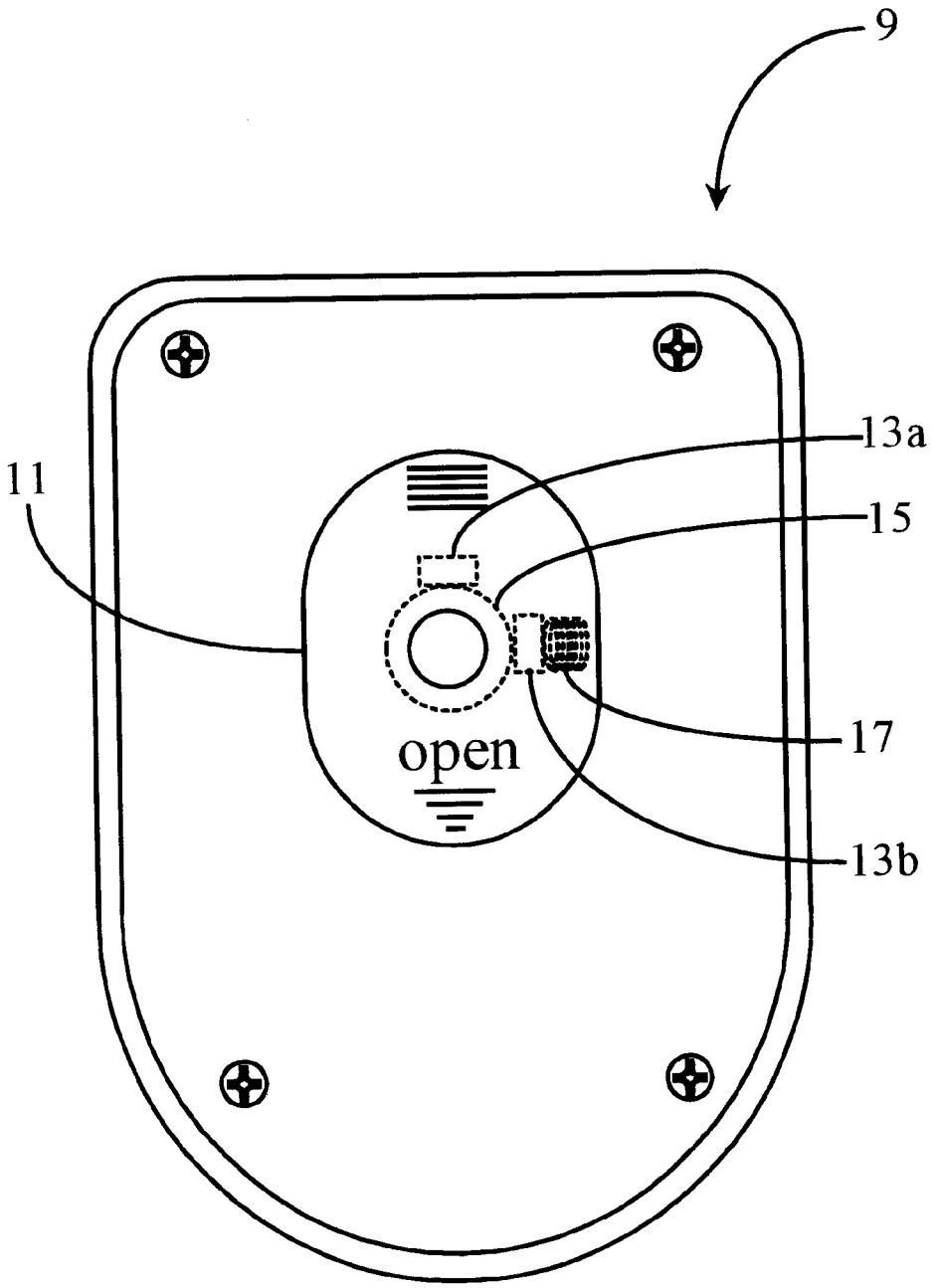
Fig.1 ( Prior Art )
FIG. 1 is an underside view of a typical mouse illustrating the ball and roller system architecture.

FIG. 1 is an underside view of a typical mouse illustrating the ball and roller system architecture. A typical computer mouse 9 is viewed from underneath showing various standard components. Trackballs have a similar structure. A removable cover plate 11 physically holds a mouse ball 15 in a spherical cavity. When mouse ball 15 is inserted into mouse 9 with cover plate 11 snapped firmly into place, mouse ball 15 makes contact with a plurality of calibrated rollers. In this example, there are two rollers 13*a* and 13*b* for providing directional input. In a typical mouse at least one tension device such as spring 17 is used to effect 100% physical contact between mouse ball 15 and the rollers. In some cases a third spring-loaded idler roller is provided to urge the ball into the directional input rollers.

The constant physical contact between mouse ball 15 and rollers 13*a* and 13*b* enables smooth and accurate directional input during operation as long as the system is clean. Smooth and accurate cursor movement is essential to successful cursor manipulation, object manipulation in drawing applications and for other purposes. As previously described in the background section, contamination of the form of lint, dust, food particles and the like eventually corrupts the ball-roller system and degrades the performance of the device.

A track ball is essentially a mouse device with the ball-roller system on the upper surface instead of the lower. Instead of rolling across a surface as with a conventional mouse, a track ball is stationary with cursor movement effected by physically manipulating the ball directly. The ball-roller system is basically identical with both types of pointer devices with an exception that a ball used with a track ball is notably larger than a mouse ball.

An object of the present invention is to provide a cleaning system and method that can be used to clean the ball-roller systems of a conventional mouse or a conventional track ball. The system of the present invention may be adapted, in various embodiments, to effectively clean any accessible ball-roller system such as may be found in a computer pointer device. More detail regarding the method and apparatus of the present invention is provided below.

Figure 2:
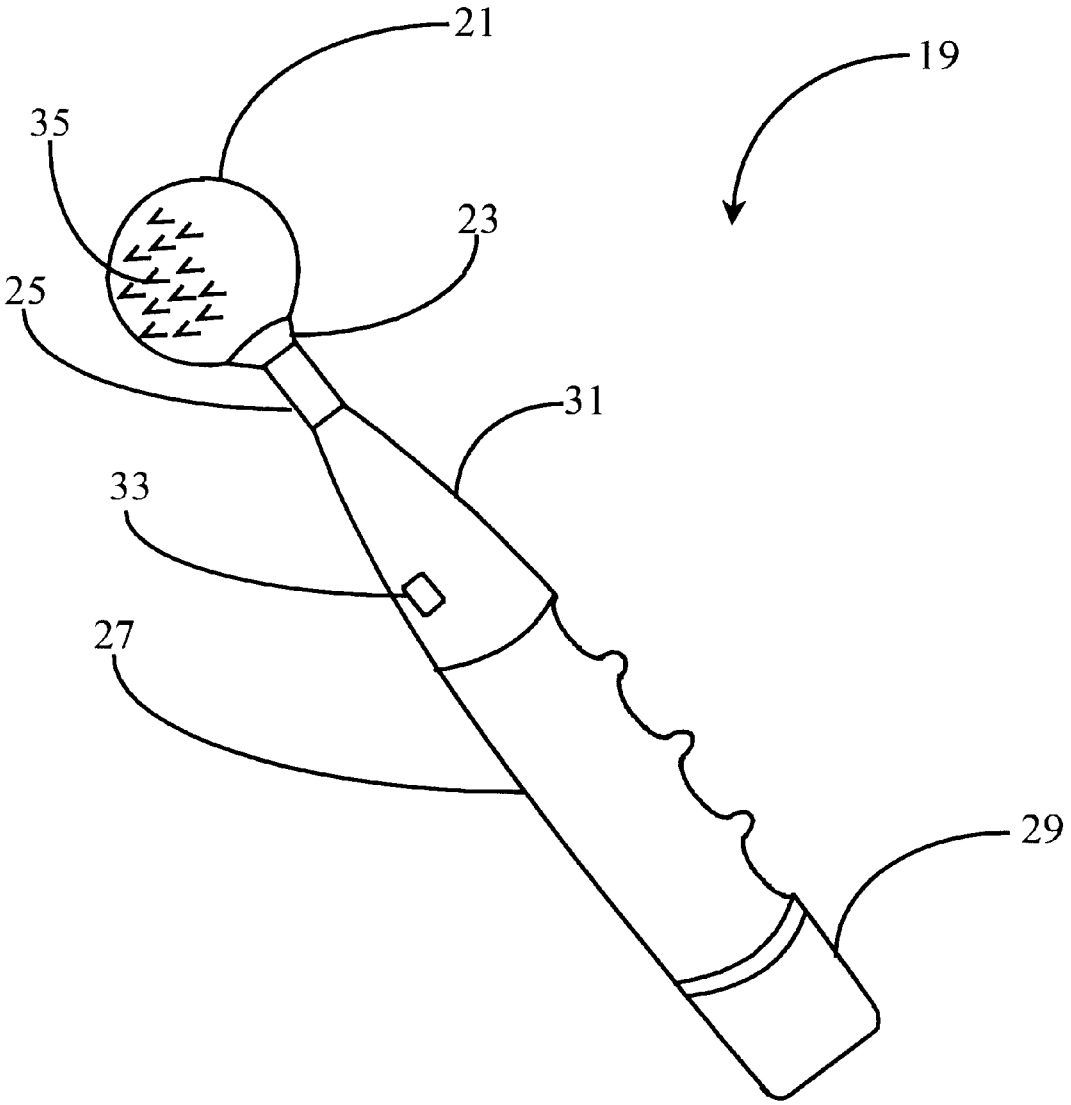
FIG. 2 is an elevation view of a hand-held mouse-cleaning system according to an embodiment of the present invention.

FIG. 2 is an elevation view of a hand-held mouse-cleaning tool 19 according to an embodiment of the present invention. Tool 19 is provided as a simple tool for cleaning a ball-roller system of a mouse such as mouse 9 of FIG. 1. Tool 19 comprises a cleaning ball 21, a rotary shaft 25, and an easy-grip handle further comprising a switch housing 31, a center section 27, and an end cap 29.

Cleaning ball 21 is mounted to rotary shaft 25 via a mounting flange 23. The mounting method used to mount ball 21 to flange 23 may vary. In a preferred embodiment, ball 21 is easily removable such as by unscrewing or unsnapping. In one embodiment of the invention, the mount is spring loaded (not shown) so that ball 21 may be removed by pushing ball 21 toward shaft 25 and than twisting one half turn thereby releasing it from flange 23. There are many quick release schemes known in the art and available for attaching ball 21 to shaft 25.

Rotary shaft 25 is mounted to a small electric motor (not shown) housed within the handle. Such motors are well-known in the art for providing rotary power. Power to hand unit 19 is effected via an on/off switch 33 located in a convenient position on switch housing 31. In a preferred embodiment, hand unit 19 is powered via batteries (not shown), however, power may also be supplied via plug-in cord (not shown).

Cleaning ball 21 in a preferred embodiment is made of a light weight, semi-pliable material such as molded rubber. Ball 21 is hollow in it's interior to add flexibility, and for another innovative reason that will be further explained below. The components making up the handle of hand unit 19 namely switch housing 31, center section 27, and end cap 29 are manufactured in a preferred embodiment of a lightweight polymer material. Other lightweight materials known in the art may also be used. Center section 27 may be affixed to switch housing 31 and end cap 29 via threaded ends that can be screwed together as with flashlights and other hollowed cylindrical products. In this embodiment, center section 27 is the predominant section of the handle and has a finger grip area (marked by depressions formed therein) to facilitate a user's grip.

The inside area of the handle houses various components necessary to unit 19 such as an electric motor, wiring, switching apparatus, circuitry, and batteries. The aforementioned components are all common and known in the art to be used for enabling function of a rotary type hand tool, therefore, much detail will not be provided in this regard. The operation of tool 19 is similar to that of a variable speed dremel tool used in metal grinding operations. When a user activates switch 33, rotary shaft 25 and mounted cleaning ball 21 spin in accordance with the speed of the motor used. The speed and direction of spin may vary according to user desire. For example, selections may be available in switch 33 for varying the speed of unit 19 and reversing the direction of spin. However, one speed in one direction is typically sufficient for the purpose of the present invention.

Cleaning ball 21 has an outer surface specifically adapted for providing the cleaning function of the ball. In a broad sense this surface is "abradant" as defined in Funk and Wagnall's New International Dictionary of the English Language, published by Publisher's International Press, Newark, N.J., USA, © 1984. The definition of the verb is: "To rub or wear off by friction. To scrape away."

In a preferred embodiment, this special surface comprises a plurality of sweeper extensions 35 protruding from the outer surface area of ball 21. Sweeper extensions 35 act to remove dust and other particulate matter from contact-rollers, such as rollers 13*a*–13*c*, by sweeping them clean during the spinning operation of ball 21. The diameter of cleaning ball 21 is held smaller than the diameter of the standard ball used in the cavity, to an extent that only sweepers extensions 35 actually make contact with rollers 13*a* and 13*b*. The sweeper extensions thus abrade the rollers to aid in removal of unwanted material. In other embodiments the ball size may be larger, and the surface of the ball is made mildly abrasive.

It will be apparent to those with skill in the art that the standard ball for a mouse or trackball is necessarily smooth. In operation foreign matter caught between the ball and one of the rollers of a pointer device using rollers and a ball my be pressed onto the surface of a roller, and remain there in a manner that the smooth rolling action required for efficient operation is periodically interrupted.

The abradant surface provided can take many forms, such as simply an irregular surface, extensions much like brush bristles, tiny scrapers, and the like.

In the case of the sweeper extensions described as an example as element 35, the angle of the extensions with the surface of ball 21 may be in one direction (pointing toward the direction of the spin), as is shown here, or may be multidirectional. Sweeper extensions 35 may be of the same material as ball 21 and may be formed during molding of ball 21 so as to be one piece with the ball. In other embodiments sweeper extensions 35 may be part of an overlay of material that adheres to ball 21 via adhesive or the like. Sweeper extensions 35 may be of many shapes as long as suitable contact with rollers is maintained. Sweepers 35 may also protrude at various angles as well as substantially 90 degrees from the surface of ball 21 without substantially affecting the cleaning operation.

In still another embodiment, a small air pump may be provided inside the handle of hand unit 19 and a line connected thereto may be provided through an inside diameter (ID) bore running through the longitudinal center of shaft 25 and into the hollowed inside of cleaning ball 21. In this case, a plurality of small openings (not shown) are provided through the surface of ball 21 allowing dust and particulate matter to be suctioned through the openings and into the interior of ball 21. The connecting passage may then carry the suctioned material to an exhaust vent through which it may be expelled. Such a vent may be conveniently located, perhaps on end cap 29. In yet another embodiment, the suctioned particulate may be trapped in a removable screen or small bag. The air pump may be driven by the same motor used to drive the shaft that turns ball 21, or by a separate drive unit.

Figure 3:
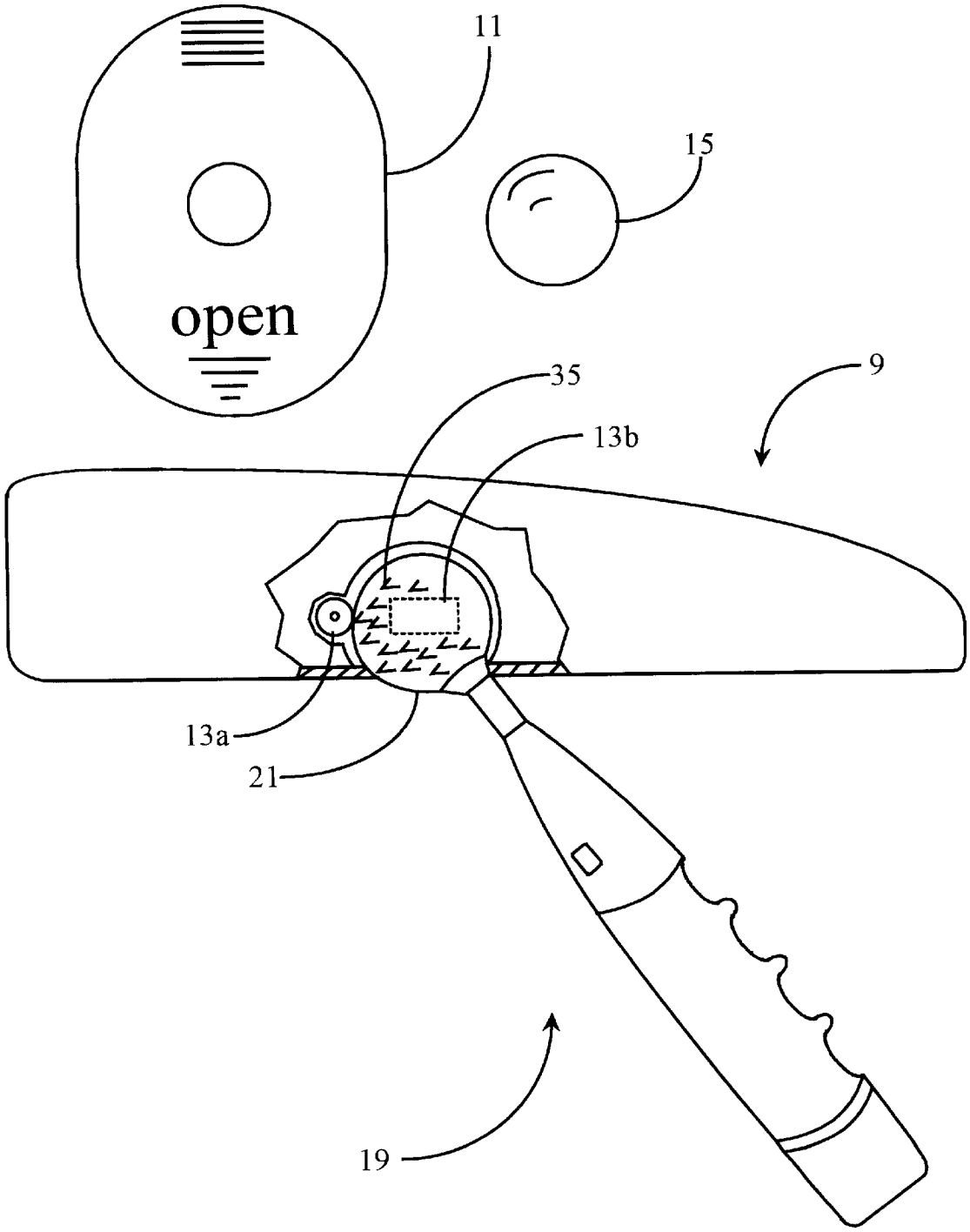
FIG. 3 is an elevation view of the hand-held cleaning system of FIG. 2 positioned for a cleaning operation according to an embodiment of the present invention.

FIG. 3 is an elevation view of tool 21 positioned for a cleaning operation according to an embodiment of the present invention. Before a user begins the cleaning operation, cover plate 11 and mouse ball 15 are removed from mouse 9 thereby exposing rollers 13*a* and 13*b*. By holding mouse 9 with one hand, and tool 19 with the other hand, a user may begin the cleaning operation. Because rollers 13*a* and 13*b* are mounted in a horizontal position with respect to mouse 9, tool 19 should be presented at an angle as shown. The exact angle is not of great importance. A range from between 20 and 45 degrees from vertical should suffice. The inventor notes that presenting tool 19 such that the motion of ball 21 is essentially parallel to the centerlines of rollers 13*a* and 13*b* will not cause the rollers to turn and present all of the surface of the rollers for cleaning.

When tool 19 is activated, ball 21 will spin causing sweepers 35 to brush against rollers 13*a* and 13*b*, turning the rollers and cleaning them of any loose or embedded unwanted material. An electronic cleaning solution may also be used in conjunction with hand unit 19. Such cleaning solutions formulated for electronic components are well known in the art. Such solutions may be applied to ball 21, sprayed on rollers, or both in combination. In one embodiment, a cleaning solution may be stored in a reservoir in hand unit 19 and caused to spray a short burst via a delivery tube running along side of or through the center of rotary shaft 25 of FIG. 2. There are many possibilities.

Figure 4:
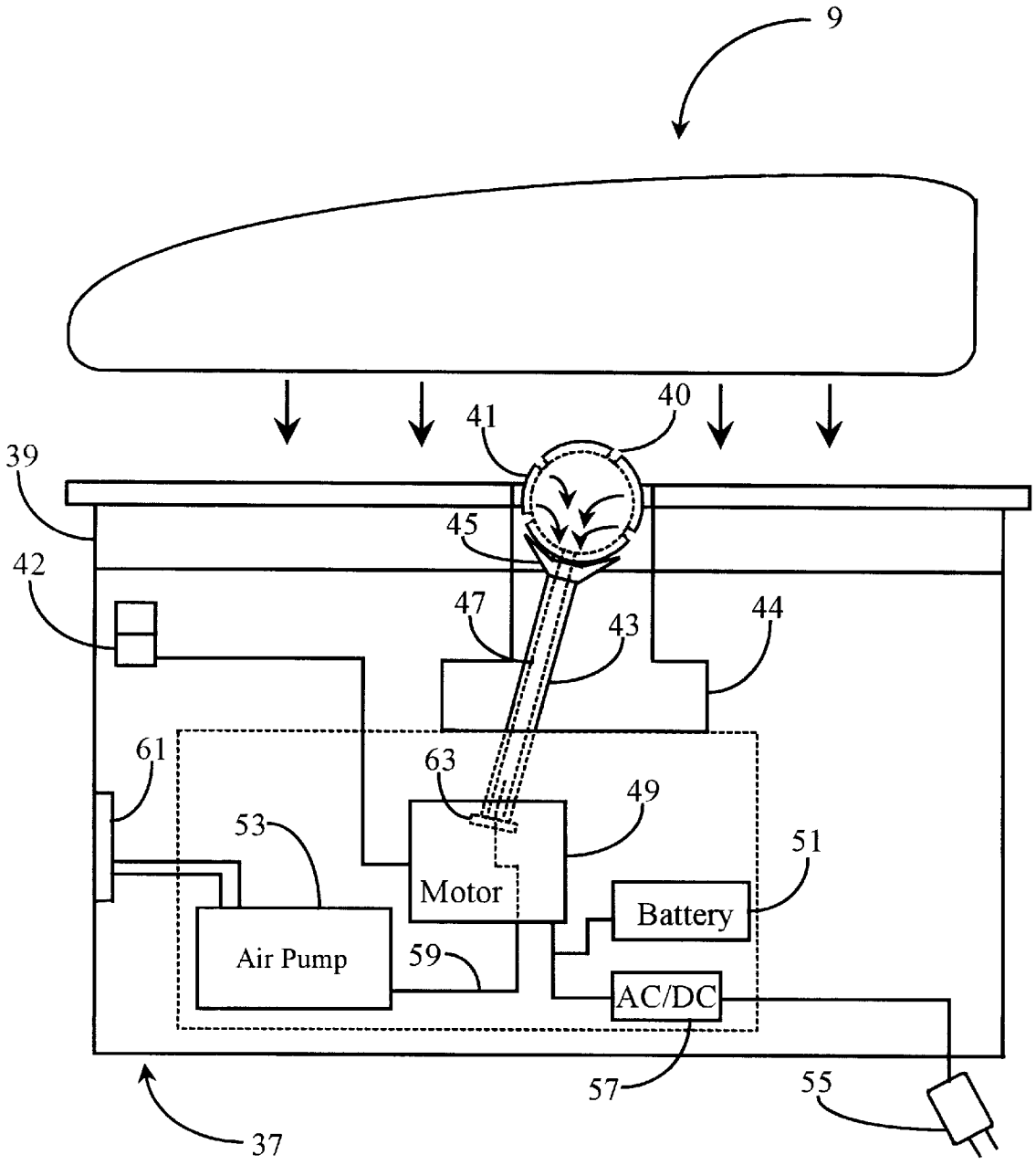
FIG. 4 is an illustrative view of a mouse-cleaning system according to another embodiment of the present invention.

FIG. 4 is an illustrative view of a mouse-cleaning system according to another embodiment of the present invention wherein a cleaning unit 37 is provided in the form of a tabletop device that may, in some instances, be mounted to a solid surface for the purpose of providing stability to the unit. Unit 37 may simply set on a surface, be mounted to a surface, or perhaps, be provided as part of the structure of a computer. In the latter instance, unit 37 may be sold as an accessory that may be affixed to, or may be part of, for instance, a computer tower.

Unit 37 has an adjustable table 39 that may be adjusted up or down according to required parameters such as the height of a mouse-ball cavity. Much like the tool 19 of FIG. 2, a cleaning ball 41 is affixed to a rotary shaft 43 via screw, snap method, or the like. Unit 37 has an electric motor for providing spin to rotary shaft 43 and an air pump 53 for suctioning loose particulate matter as described above with reference to FIG. 3.

An ID bore 47 is provided through the length of rotary shaft 43 and into the interior of cleaning ball 41. A vacuum guard 45 is affixed to rotary shaft 43 so as to become an integral part of rotary shaft 43. The function of vacuum guard 45 is to add vacuum capability to the outside surface area of ball 41 and to trap any material that might in-advertantly become stuck to ball 41. A vacuum line 59 provides a suctioning passage for air pump 53 through rotary shaft 43 via an ID bore 47. ID bore 47 extends into the inside area of cleaning ball 41. A plurality of small openings 40 may be provided through the shared wall of ID bore 47 and rotary shaft 43 at a location where vacuum guard 45 adjoins rotary shaft 43 for the purpose of providing suction power both to the inside of ball 41, and to the out side area of ball 41 covered by vacuum guard 45. In this way, particles suctioned into ball 41 through openings beneath sweepers as described with reference to FIG. 3, and particles trapped in vacuum guard 45 may be suctioned to exhaust. An exhaust vent and tube structure 61 is shown connected to air pump 53 for the aforementioned purpose. All of the added function described in this embodiment may also be utilized in a hand-held version of the mouse cleaner such as tool 19 of FIG. 2.

As with tool 19 of FIG. 2, power to unit 37 may be supplied by a battery 51 or an AC/DC adapter 57 with a plug-in cord 55. An on/off switch 42 shown wired to motor 49 provides power to unit 37. As can be seen in this embodiment, rotary shaft 43 is mounted at an angle from vertical. Suitable clearance for this angled presentation is provided via a clearance cavity 44. The reason for the angled presentation is the same as described with reference to FIG. 3. An adjustment feature (not shown) regarding the angle of mount of shaft 43 may be provided so that a user may fine tune the presentation. The aforementioned adjustment feature may be of the form of a pivotal and lockable motor mount accessible to the user perhaps by removing a cover or the like. Such features are known in the art and easily provided.

It will be apparent to one with skill in the art that a desktop mouse-cleaning unit such as unit 37 may be mounted to a surface or made into part of the computer without departing from the spirit and scope of the present invention, such as by mounting the unit to a computer tower or the like. It will also be apparent to one with skill in the art that power to unit 37 may be effected via a variety of techniques known in the art. In one embodiment, power to unit 37 is effected via a user placing a mouse over cleaning ball 41 and against adjustable table 39 with sufficient force required to trigger a pressure sensitive switch. In this case, an on/off switch such as switch 42 would not be required.

In still another embodiment, a hand held unit such as tool 19 of FIG. 2 may be adapted to dock into a housing similar to the housing structure containing the components of unit 37 of FIG. 4 including an adjustable table. In this way the invention may function as a hand-held unit or a stationary desk-top unit. Additional cleaning balls as accessories are provided to facilitate a larger mouse-ball cavity such as those typically found in a track ball. The exact size of a cleaning balls will conform to industry standards. The spirit and scope of the present invention is limited only by the claims that follow.

What is claimed is:

1. A hand-held cleaning apparatus for a computer pointing device having a rollable ball of a standard size and internal rollers adapted to provide directional input, comprising:

a housing adapted to a user's hand;

a rotatable shaft connected to a rotary drive within the housing; and a cleaning ball having an abradant surface, including a plurality of small openings, mounted to the rotatable shaft outside the housing; and an air pump connected to the openings through the abradant surface of the cleaning ball;

wherein the size of the cleaning ball is the standard size of the rollable ball of the computer pointing device, and the air pump provides an egress of air to sweep matter abraded from the rollers from within the pointer device.

2. The apparatus of claim 1 further comprising an on-off switch.

3. The apparatus of claim 1 wherein the rotary drive is a variable speed drive including a user-input for varying the speed.

4. The apparatus of claim 1 wherein the abradant surface is provided by brush-like bristles on the ball surface.

* * * * *